US006779304B2

(12) United States Patent
Murphy

(10) Patent No.: US 6,779,304 B2
(45) Date of Patent: Aug. 24, 2004

(54) WALL OPENING FALL PROTECTION SUPPORT BRACKETS

(75) Inventor: John Joseph Murphy, Stuart, FL (US)

(73) Assignee: Innovative Safety Products Incorporated, Stuart, FL (US)

( * ) Notice: Subject to any disclaimer, the term of this patent is extended or adjusted under 35 U.S.C. 154(b) by 0 days.

(21) Appl. No.: 10/372,881

(22) Filed: Feb. 24, 2003

(65) Prior Publication Data

US 2004/0111971 A1 Jun. 17, 2004

Related U.S. Application Data

(60) Provisional application No. 60/433,710, filed on Dec. 16, 2002.

(51) Int. Cl.[7] ..... E06B 3/68
(52) U.S. Cl. ..... 49/57; 49/463; 292/259 R
(58) Field of Search ..... 49/50, 57, 463; 52/202, DIG. 12; 292/259 R, 288, 289

(56) References Cited

U.S. PATENT DOCUMENTS 212,242 A * 2/1879 Loper ..... 292/259 R
3,282,547 A 11/1966 Ables
3,376,669 A * 4/1968 Johnston ..... 49/382
3,980,328 A * 9/1976 Pearson ..... 292/256
4,082,332 A * 4/1978 Palmer ..... 292/259 R
D270,572 S 9/1983 Black
5,335,452 A * 8/1994 Taylor ..... 49/463
D397,014 S 8/1998 Wilson
5,829,549 A 11/1998 Flynn
6,220,577 B1 4/2001 Ostrow
6,345,689 B1 2/2002 McNamee
D471,291 S 3/2003 Ammons
D473,125 S 4/2003 Conroy

OTHER PUBLICATIONS

U.S. Department of Labor, Occupational Safety & Health Administration, Fall Protection Systems Criteria and Practices.—1926.502.

* cited by examiner

*Primary Examiner*—Jerry Redman
(74) *Attorney, Agent, or Firm*—Christopher & Weisberg, P.A.

(57) ABSTRACT

A wall opening fall protection support system is provided having a pair of brackets, each bracket of the pair having a substantially planar mounting portion, a support portion, a retaining portion including a locking element, and a standoff element, wherein the retaining portion is resiliently joined to the support portion. The system can further include a rail securable to each bracket by the retaining portion so as to be at least partially surrounded by the support portion, the retaining portion and the standoff element.

1 Claim, 3 Drawing Sheets

WALL OPENING FALL PROTECTION SUPPORT BRACKETS

CROSS-REFERENCE TO RELATED APPLICATION

This application is related to and claims priority to U.S. Provisional Patent Application Serial No. 60/433,710 filed Dec. 16, 2002, entitled WALL OPENING FALL PROTECTION SUPPORT BRACKETS, the entirety of which is incorporated herein by reference.

STATEMENT REGARDING FEDERALLY SPONSORED RESEARCH OR DEVELOPMENT n/a

FIELD OF THE INVENTION

The present invention relates to a method and system for enhancing safety at a construction site, and more particularly to a system for hindering inadvertent passage through a wall opening.

BACKGROUND OF THE INVENTION

Part of the process of constructing buildings includes the creation or definition of spaces that will become doors and windows in what are otherwise substantially solid walls. However, as the doors and windows themselves can be relatively expensive and easily damaged during active construction, the doors, windows, and elevators are often installed after much construction work has been accomplished. Further, as the door and window openings are often a primary passageway for introduction of building supplies, it is desired, if not imperative to have the largest possible, unimpeded openings.

In low, one level buildings, unobstructed wall openings present little danger. However, as a building increases in height to two or more levels, the danger associated with unobstructed or guarded wall openings increases. Specifically, if a construction worker falls from the building due to accidental passage through a wall opening, there is a high likelihood of injury or death.

In recognition of the serious danger related to falling from such openings, the United States Occupational Safety and Health Administration (OSHA) requires that an obstruction be placed in wall openings at a height of 42 inches, plus or minus three inches, so as to withstand 200 pounds falling into it in an "outward" and/or "downward" direction. The OSHA requirements are set forth in detail in 29 CFR 1926.502. In practice, these obstructions are pieces of wood, such as "2×4's" that are nailed to the wall on opposite sides of the opening. However, as described above, the wall openings are primary passages for building materials to and from buildings. Thus, the obstructions must be removed to allow passage and replaced following passage. The obstructions must also be removed when furring strips are installed on the walls.

It has been discovered that boards that are nailed into a wall so as to be easily removed, do not provide adequate resistance to falling forces. However, when a board is repeatedly, securely nailed to a wall, the wall can become severely damaged. Further, it has been discovered that because of the tedium in ripping a board from a wall and renailing it each time equipment or material pass through an opening being protected, that the opening is often left unguarded in contravention to OSHA guidelines.

It would therefore be desirable to provide a system for blocking a wall opening in accordance with OSHA guidelines that is so easy to use that it actually will be used.

SUMMARY OF THE INVENTION

The present invention advantageously provides a method and system for enhancing safety at a construction site, and more particularly to a system for hindering inadvertent passage through a wall opening.

In an exemplary embodiment, a wall opening fall protection support system includes a pair of brackets, each bracket of the pair having a mounting portion, a support portion and a retaining portion; and a rail, wherein the rail is securable to each bracket by the retaining portion. More particularly the system can include a pair of brackets, each bracket of the pair having a substantially planar mounting portion, a support portion, a retaining portion including a locking element, and a standoff element wherein the retaining portion is resiliently joined to the support portion; and a rail, wherein the rail is securable to each bracket by the retaining portion so as to be at least partially surrounded by the support portion, the retaining portion and the standoff element.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1A:
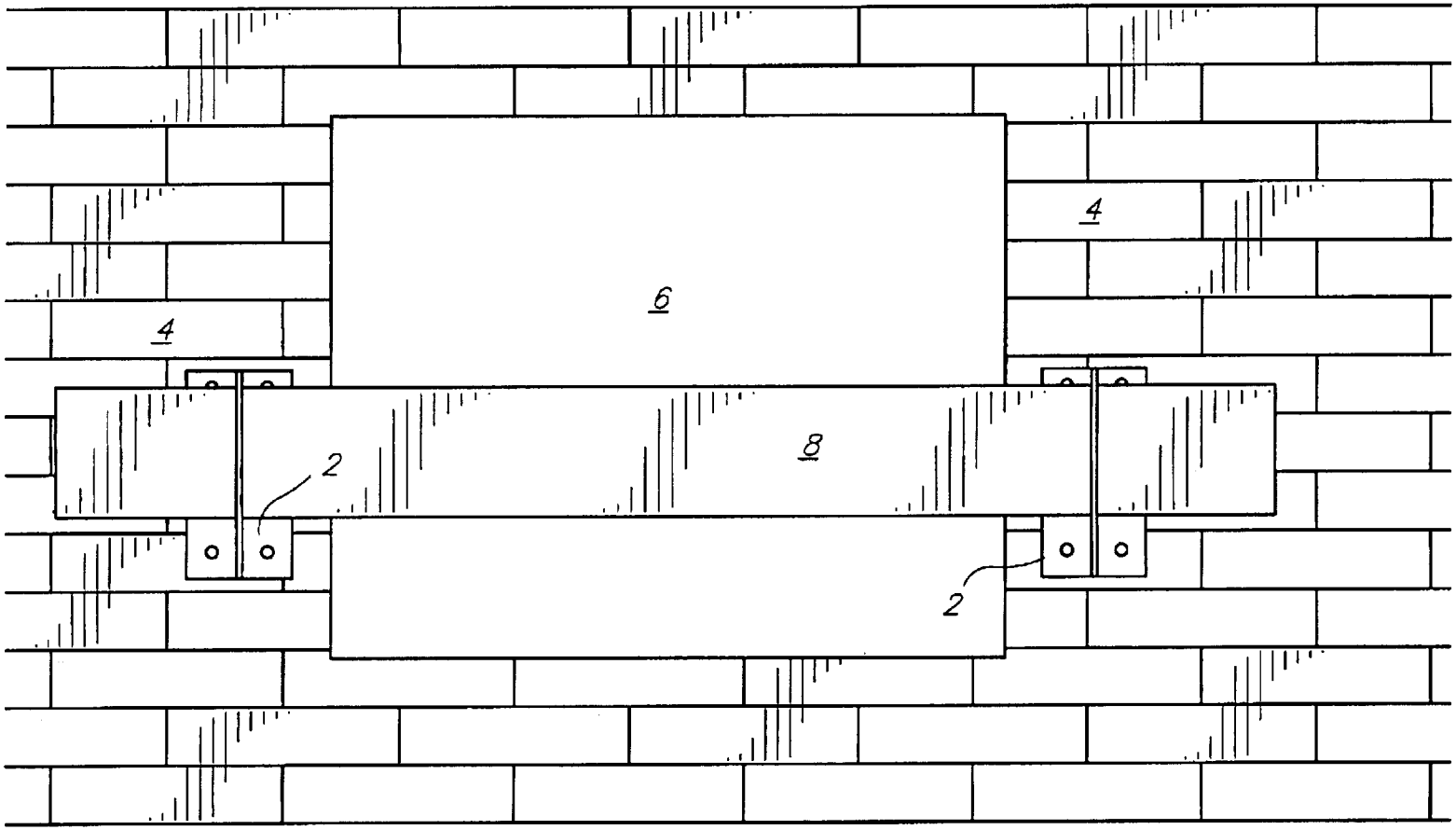
FIG. 1*a* illustrates a wall opening fall protection system of the present invention in use to obstruct an opening in a building under construction.
Figure 2:
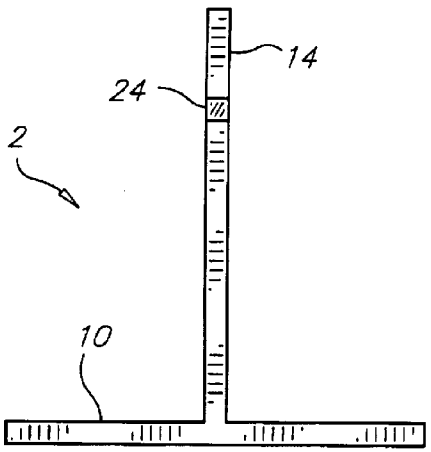
FIG. 2 is a front perspective view of the bracket of FIG. 1*b;*
Figure 3:
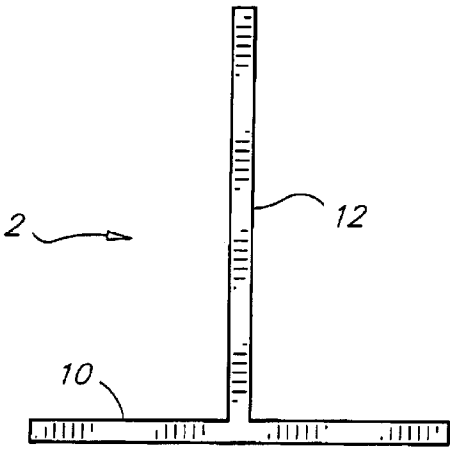
FIG. 3 is top view thereof.

The present invention and its attendant advantages are best understood by viewing the invention in context or use, after which the specific structural details of the system components are described. Accordingly, we begin by referring to FIG. 1*a*, which illustrates a wall opening fall protection system of the present invention in use. The system includes a pair of brackets 2 secured to a wall 4 on opposite sides of an opening 6 (e.g., door, window, elevator) defined by the wall. A rail 8 is supported and retained by the brackets so as to meet OSHA fall protection requirements. Although the invention is compatible with rails of different configurations, the system shown is configured to use the ubiquitous two-inch by four inch cross-section wooden members commonly used in almost all phases of typical construction projects. In use, the rail 8 is easily removed and replaced within the brackets 2 as required to permit passage through the opening 6.

Figure 1B:
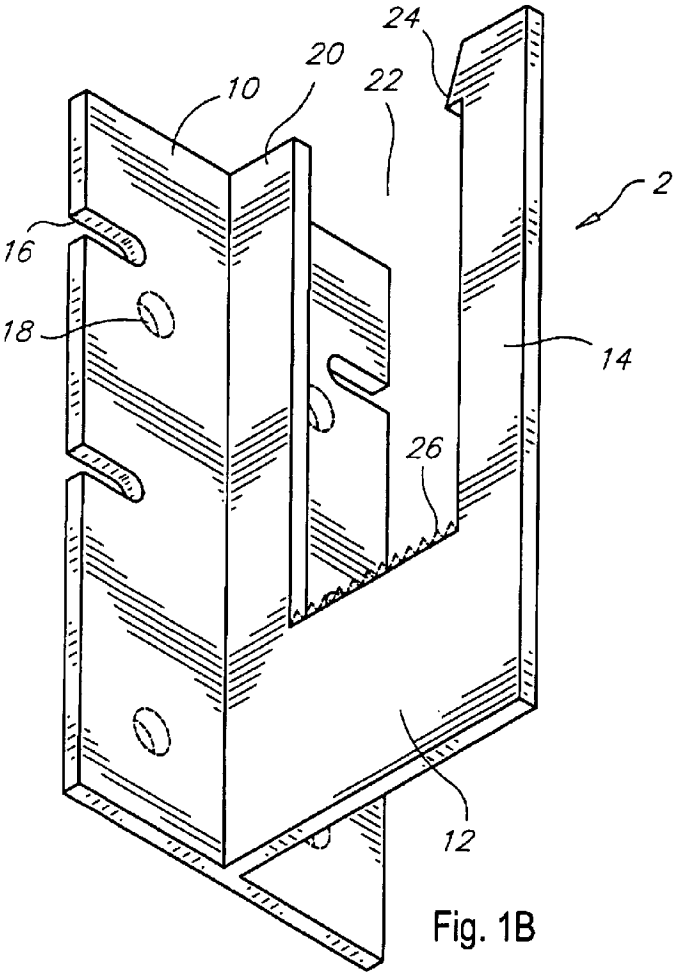
FIG. 1*b* is a wall opening fall protection support bracket in accordance with the invention as shown in FIG. 1*a;*
Figure 6:
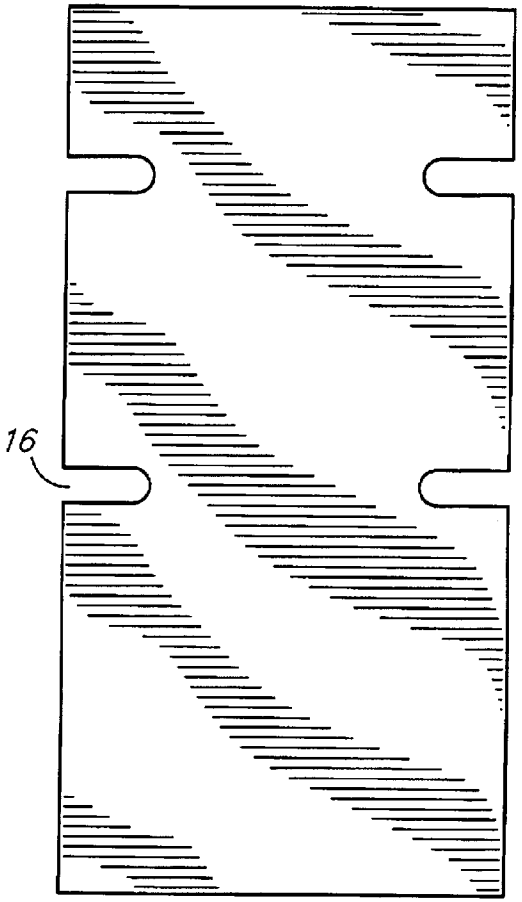
FIG. 6 is a rear view thereof.
Figure 5:
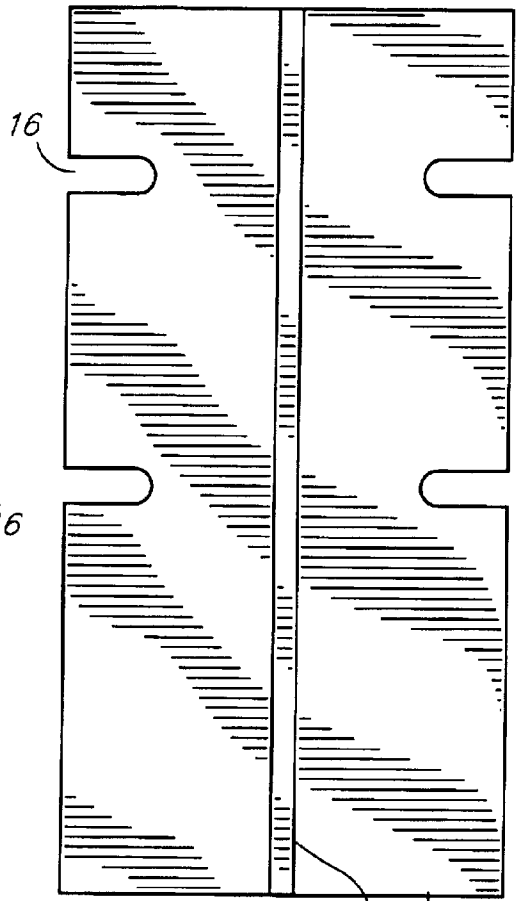
FIG. 5 is a front view thereof.
Figure 4:
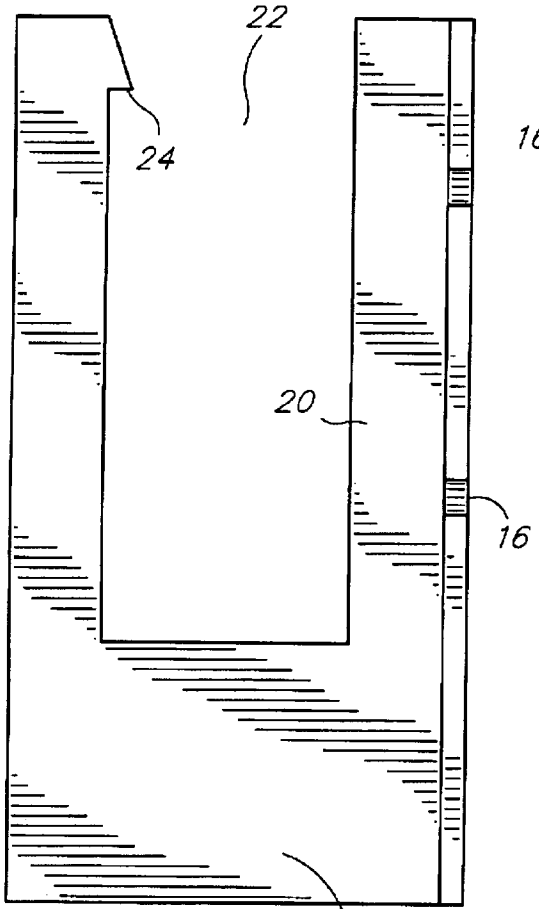
FIG. 4 a left side view thereof, the right side being a mirror image thereof.

Referring now to FIG. 1*b*, an exemplary safety bracket in accordance with the invention is illustrated, wherein the bracket includes a mounting portion 10, a support portion 12 and a retaining portion 14. FIGS. 2–6, although not described separately below, illustrate the various features of the bracket described herein with respect to FIG. 1*b* from differing perspectives.

As shown, the mounting portion 10 is a substantially planar element. The mounting portion is provided with one or more apertures therethrough that are dimensioned to receive screws, nails, tapcons, or bolts. As shown, the apertures can be notches 16 in the periphery of the mounting portion 10 or holes that arc away from the periphery. Although two symmetrically located apertures (notches) on opposite sides of the mounting portion 10 are shown, fewer or more apertures can be provided depending on the type of fixation device used (e.g., screw, bolt, tapcon) and the composition of the material to which the bracket is to be secured.

The bracket can further include a standoff element 20 that extends from the mounting portion 10. The standoff element 20 allows for easier grasping of the rail 8 (shown in FIG. 1*a*). In the exemplary embodiment the standoff element 20 extends about one inch from the mounting portion 10 to provide room for placement of furring on the wall 4. Thus, the standoff element 20, the support portion 12 and the retaining portion 14 define a receiving notch 22 for the rail. In the exemplary embodiment, the receiving notch 22 is defined to have a substantially identical profile as the rail (e.g., a two inch by four inch notch).

The receiving notch 22 can be characterized as generally "U" shaped, wherein the "bottom" of the U is flat and wherein the support portion 12 defines the bottom of the "U." To facilitate easy placement and removal of the rail 8 within the notch 22, the retaining portion 14 can be movable with respect to the support portion. In the exemplary embodiment, the bracket is made of a high density plastic or polymer and the retaining portion 14 is thus resiliently formed with or joined to the support portion 12.

To help ensure that the rail 8 is not too readily dislodged from the bracket 2, engagement means can be provided to inhibit movement of the rail 8 with respect to one or both of the brackets 2. For example, a locking element 24 can be provided to inhibit vertical motion of the rail 8 from the bracket 2. As shown, the locking element 24 can be a protuberance on the retaining portion 14 that extends over the support portion 12 to partially cover the top of the rail 8. In other embodiments, the locking clement can include a strap, band, or clip that extends from the top of the retaining portion to the top of the standoff element.

Additionally, the engagement means can include one or more of the inwardly directed faces of the support portion 12, retaining portion 14, and/or standoff element 20 being provided with fixation enhancements such as "tacky" adhesive or textured surfaces to inhibit lateral movement of the rail 8. For example, as shown in FIG. 1, the support portion 12 can be provided with "teeth" or serrations 26 that engage the rail 8 when the rail is placed into the notch 22.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A wall opening fall protection support system comprising:

a pair of brackets, each bracket of the pair having a mounting portion, a support portion and a retaining portion;

a standoff element extending from the mounting portion;

a rail, wherein the rail is securable to each bracket by the retaining portion;

wherein the standoff element, support portion and retaining portion define a receiving notch for the rail;

wherein the receiving notch is generally "U" shaped and wherein the support portion defines the bottom of the "U";

wherein the retaining portion is movable with respect to the support portion;

wherein the retaining portion is resiliently joined to the support portion; and a locking element disposed on the retaining portion, wherein the locking element is a protuberance that extends over the support portion.

* * * * *